US005156707A

United States Patent [19]

Kato et al.

[11] Patent Number: 5,156,707

[45] Date of Patent: Oct. 20, 1992

[54] SUPPORT FOR PHOTOGRAPHIC PRINTING PAPER

[75] Inventors: Atsushi Kato; Yasuo Iwasaki; Sei Kawahara, all of Shizuoka, Japan

[73] Assignee: Fuji Photo Film Co., Ltd., Kanagawa, Japan

[21] Appl. No.: 591,639

[22] Filed: Oct. 2, 1990

[30] Foreign Application Priority Data

Oct. 3, 1989 [JP] Japan ..... 1-259194

[51] Int. Cl.[5] ..... D21H 19/82

[52] U.S. Cl. ..... 162/137; 162/168.1; 162/169; 162/181.6; 428/451; 428/511; 428/512; 428/513; 428/520; 428/537.5; 430/272; 430/536

[58] Field of Search ..... 162/135, 137, 181.6, 162/168.1, 168.2, 168.3, 169, 168.6; 427/397.7, 411; 430/272, 536; 428/511, 512, 513, 520, 537.5, 451

[56] References Cited

U.S. PATENT DOCUMENTS

| | | | |
|---|---|---|---|
| 3,169,519 | 12/1964 | Alsup | 430/536 |
| 3,630,740 | 12/1971 | Victor et al. | 430/536 |
| 3,676,189 | 7/1972 | Woodward et al. | 430/536 |
| 3,914,522 | 10/1975 | Saverin et al. | 427/397.7 |
| 4,605,612 | 8/1986 | Tamagawa et al. | 430/536 |
| 4,614,688 | 9/1986 | Tamagawa et al. | 430/536 |
| 4,705,746 | 11/1987 | Tamagawa et al. | 430/536 |

FOREIGN PATENT DOCUMENTS

| | | |
|---|---|---|
| 0312638 | 10/1987 | Fed. Rep. of Germany . |
| 1574294 | 9/1980 | United Kingdom . |
| 0080225 | 6/1983 | United Kingdom . |

OTHER PUBLICATIONS

Patent Abstracts of Japan, vol. 11, No. 177 (P-583)(2624) Jun. 6, 1987 for JP-A-62 006256 (Fuji Photo Film Co., Ltd.) Jan. 13, 1987.

Patent Abstracts of Japan, vol. 12, No. 97 (P-682)(2944) Mar. 30, 1988 for JP-A-62 231254 (Mitsubishi Paper Mills Ltd.) Oct. 9, 1987.

Patent Abstracts of Japan, vol. 11, No. 201 (P-590)(2648) Jun. 30, 1987 for JP-A-62 023039 (Mitsubishi Paper Mills Ltd.) Jan. 31, 1987

*Primary Examiner*—Peter Chin

*Attorney, Agent, or Firm*—Sughrue, Mion, Zinn, Macpeak & Seas

[57] ABSTRACT

A support for photographic printing paper comprising a water resistant support comprising a raw paper with a polyethylene resin coated on both sides thereof, and a back layer provided on the support, wherein the back layer comprises:

(a) colloidal silica;

(b) an aqueous dispersion of a styrene-acrylate copolymer as obtained by polymerizing in the presence of a water-soluble polymer; and (c) at least one member selected from the group consisting of a water-soluble polymer compound containing a carboxylic group or a sulfone group, or its salt, and a hydrophilic organic polymer colloid.

17 Claims, No Drawings

SUPPORT FOR PHOTOGRAPHIC PRINTING PAPER

FIELD OF THE INVENTION

The present invention relates to a support for photographic printing paper which has excellent water resistance, and more particularly to a support for photographic printing paper which has excellent writing properties on the back surface thereof.

BACKGROUND OF THE INVENTION

Raw paper is usually used as a substrate of photographic printing paper. In order to impart water resistance to the raw paper, a polyolefin resin, such as polyethylene, is coated on both surfaces of the raw paper. In a support for photographic printing paper, using raw paper coated with such a polyolefin resin, the surface on which a photographic emulsion layer is coated is called a "top surface", and the surface on which no photographic emulsion layer is coated is called a "back surface".

It is desirable that the back surface can be written on with a ball point pen, a fountain pen, or a pencil, for example.

For the purpose of automatically cutting by clearly indicating the boundary between a picture cut and a picture cut of a silver halide photographic material in a roll-form, or for the purpose of writing information concerning a picture cut, type writing is sometimes applied onto a back coat layer on the back surface of the silver halide photographic material in a printer.

A problem arises in that when the ink flows in a processing bath and the color becomes faded, the photographic printing paper does not sufficiently perform properly. Thus, a support for photographic printing paper which is freed from the above problem is desired.

However, since the polyolefin resin layer covering the surface of the raw paper usually does not have ink absorbility, when an ink is applied thereon, drying of the ink is slow, and moreover the ink after drying readily disappears by friction (by rubbing with a hand, for example) and is easily scratched in writing. Moreover, when a printing paper is superposed, the information written or typed is easily transferred to the surface of another printing paper. Thus there is a disadvantage that it is difficult to write characters or figures with a pencil or fountain pen on the surface of the polyolefin resin layer.

Although the above defect is improved by roughening the surface of the polyolefin resin layer by sand blast or embossing, or by a method of etching the surface with an acid, for example, it cannot be said that writing properties are sufficiently satisfactory.

Thus, heretofore, in order to overcome the above problems, for example, a method of incorporating an inorganic pigment of 1 to 40 μm into the polyolefin resin layer on the back surface (JP-A-55-43528 (the term "JP-A" as used herein means an "unexamined published Japanese patent application)), a method of providing a layer comprising a water-soluble polymer, such as polyvinyl alcohol or carboxymethyl cellulose, and water-soluble silica sol (JP-B-44-14884 (the term "JP-B" as used herein means an "examined published Japanese patent application"), corresponding to U.S. Pat. No. 3,520,242), a method of providing a layer comprising a water-insoluble polymer emulsion, such as a polyethylene emulsion, and water-soluble silica sol (JP-B-50-36565, corresponding to U.S. Pat. No. 3,676,189), and a method of providing a coated layer containing a pigment, such as clay, and having moisture absorbing properties (JP-A-52-169426) have been proposed.

These methods, however, have the following problems. For example, when an inorganic pigment of 1 to 40 μm is incorporated into the polyolefin resin layer on the back surface, a problem arises in that the resin layer is cracked, or contamination with the pigment occurs. Moreover, in the coated layer of the conventionally used composition, to obtain sufficiently satisfactory writing properties with a pencil, the coating amount should be controlled to about 5 g/m$^2$ and in some cases, to more than 10 g/m$^2$. Thus, there are many limitations in the process of production, such as a drying step of the coated layer.

In the photographic developing step, the coated layer is removed or dissolved, or after development, the pigment is removed only by slight friction. Thus, problems occur concerning the quality, such as contamination of the photographic printing paper.

Moreover, for the purpose of decreasing the cost of the product, the treatment solution is continuously recycled in the developing treatment system of the silver halide photographic material. In this case, the oxidized product of an organic compound dissolved from the photographic material into the treatment solution tends to accumulate therein as a contamination substance, which disadvantageously adheres to the support, in particular, on the back surface thereof.

The above disadvantages results in the unsatisfactory writing properties of the polyolefin resin layer on the back surface of the photographic printing paper. Also, written information is transferred to the top surface of another printing paper, contamination is caused by a contaminating substance and the coated layer provided to overcome the above disadvantages is subject to elution or removal during the developing processing. These problems have been addressed by providing a print-storing layer in which an inorganic pigment having a number average particle diameter of 0.1 to 3.0 μm and an oil absorption amount of not more than 100 ml/100 g is dispersed in a binder including a styrene-acrylate copolymer, on the back surface of the support (see JP-A-62-6256). However, further improvements in ink printing properties, controlling contamination during the developing processing, and so forth are desired.

As a result of investigations to overcome the above problems, it has been found in the present invention that ink printing properties and contamination are markedly improved by using colloidal silica as an inorganic pigment and, at the same time, by using an aqueous dispersion of styrene-acrylate obtained by polymerizing in the presence of a water-soluble polymer.

SUMMARY OF THE INVENTION

An object of the present invention is to provide a support for photographic printing paper, which is improved in ink writing properties, printing properties, and contamination during the developing processing.

This and other objects of the present invention, which will be readily apparent from the detailed description of the invention provided hereinafter, have been met by a support for photographic printing paper, comprising a water resistant support with a polyolefin resin coated on both surfaces of a raw paper, and a back layer provided on the back surface of the support, wherein the back layer comprises:

(a) colloidal silica;

(b) an aqueous dispersion of a styrene-acrylate copolymer polymerized in the presence of a water-soluble polymer; and (c) at least one member selected from the group consisting of a water-soluble polymer compound containing a carboxylic group or a sulfone group, or its salt, and a hydrophilic organic polymer colloid.

DETAILED DESCRIPTION OF THE INVENTION

The raw paper to be used in the present invention is chosen from materials generally employed in supports for photographic printing paper. Examples of such materials are natural pulp obtained from needleleef trees or boradleef trees, synthetic pulp obtained using polyethylene or polypropylene in a fibrous form, and a mixture of natural pulp and synthetic pulp.

The raw paper may contain additives generally used in paper making, such as a fluorescent brightener, a sizing agent, a paper reinforcing agent, a fixing agent, a preservative, a filler, and an antistatic agent, and a surface sizing agent, and so forth.

The raw paper usually has a thickness of 50 to 300 μm.

As the polyolefin resin to be coated on both surfaces of the raw paper, α-olefin homopolymers such as polyethylene and polypropylene, or α-olefin copolymers, and mixtures thereof can be used. Particularly preferred polyolefins are high density polyethylene, low density polyethylene, and mixtures thereof. These polyolefins are not limited in molecular weight as long as they can be used for extrusion coating. Usually polyolefin having a molecular weight of 20,000 to 200,000 are used.

The polyolefin resin layer is not limited in thickness. The thickness of the polyolefin resin layer can be determined depending on the thickness of the polyolefin resin layer of conventional supports for photographic printing paper. The thickness is usually 15 to 50 μm.

Into the polyolefin resin layer, known additives such as a white pigment, a color pigment or a fluorescent brightener, and an antioxidant can be incorporated. In particular, into the polyolefin resin layer on the surface at which the photographic emulsion is to be coated, a white pigment or a color pigment is preferably incorporated.

Colloidal silica as the component (a) to be used in the back layer of the present invention can be appropriately chosen from those known silicas having an average particle diameter of about 5 to 100 μm, preferably 10 to 50 μm (measured, e.g., by Bett method). Examples of such colloidal silicas are commercially available silica sol suspensions, such as Ludox HS, Ludox AS, etc. (trade names, manufactured by Dupont Corp.), and Snowtex 20, Snowtex 30, Snowtex C (colloidal silica coated with alumina on the surface thereof), etc. (trade names, manufactured by Nissan Kagaku Co., Ltd.). The amount of the colloical silica used is preferably 0.01 to 1.0 g /m$^2$ and more preferably 0.05 to 0.5 g/m$^2$.

In the present invention, the colloidal silica can be used in combination with conventionally known inorganic pigments in the amount of 0.05 to 1.0 g/m$^2$. In particular, those having an oil absorption amount of not more than 100 ml/100 g and a number average particle size of 0.1 to 3.0 μm are preferably used in combination.

The water-soluble polymer to be used in preparation of the aqueous dispersion of the styrene-acrylate copolymer as the component (b) is appropriately selected from known water-soluble polymers, such as PVA, carboxy-modified PVA, a styrene-maleic acid copolymer or its salt, polyacrylic acid, polystyrenesulfonic acid, and a water-soluble acryl compound. Of these, a styrene-maleic acid copolymer is particularly preferred.

The amount of the water-soluble polymer used may be 10 to 60% by weight based on the sum of the weights of styrene monomer and acrylate monomer.

The molar ratio of styrene to acrylate to be radical polymerized in a system containing the above water-soluble polymer is preferably in a range of 90/10 to 10/90, more preferably 50/50 to 80/20.

If the styrene content is more than about 90%, the glass transition temperature of the copolymer is too high. Thus, the coating is not sufficiently formed under usual drying conditions, and its adhesive force to the polyolefin layer tends to be decreased.

On the other hand, if the styrene content is less than about 10 mol %, the glass transition temperature is too low. Thus, at the time of winding in the course of production of the polyolefin-coated paper, it is easily bonded to the surface of the raw paper, or at the time of winding after coating of the emulsion, it is easily bonded to the emulsion layer.

The molecular weight of the styrene-acrylate copolymer is preferably in the range of 100,000 to 1,000,000, more preferably 200,000 to 500,000.

Examples of the acrylate to be used in the above styrene-acrylate include esters of acrylic acid and aliphatic alcohols having 1 to 8 carbon atoms, such as methyl acrylate, ethyl acrylate, n-propyl acrylate, isopropyl acrylate, n-butyl acrylate, sec-butyl acrylate, tert-butyl acrylate, hydroxypropyl acrylate, 2-hydroxyethyl acrylate, and 2-ethylhexyl acrylate. Among them, 2-ethylhexyl acrylate is preferred.

In order to increase the adhesive force to the polyolefin, to increase the stability of the solution, or to increase water resistance, chemical resistance, and thermal resistance, the styrene-acrylate copolymer may be copolymerized with a cross-linkable divinyl compound, such as ethyleneglycol diacrylate, polyethyleneglycol diacrylate, ethyleneglycol methacrylate, polyethyleneglycol dimethacrylate, and divinylbenzene, or may be copolymerized with an N-containing monomer such as N-methylolacrylamide, acrylamide, and diacetone-acrylamide, or may be copolymerized with a carboxyl group-containing component, such as acrylic acid, methacrylic acid, itaconic acid, crotonic acid, sorbic acid, sinnamic acid, citraconic acid, mesaconic acid, maleic acid, fumalic acid, etacrylic acid, maleic anhydride, and itaconic anhydride, or may be copolymerized with a glycidyl group-containing component such as glycidyl methacrylate, or may be copolymerized with a hydroxyl group-containing monomer such as hydroxyethyl methacrylate and hydroxypropyl acrylate, in the amount of about 0.05 to 30% by weight based on the weight of the solids of the emulsion.

Into the above emulsion, if desired, a wetting agent, an emulsifying agent, an antioxidant, an aging agent, a stabilizer, a cross-linking agent, an antistatic agent, and the like can be incorporated.

In particular, use in combination with a cross-linking agent containing at least two ethyleneimino groups or glycidyl ether groups in the molecule thereof is effective in improving the hardness of the coated film, and at the same time, is effective in preventing ink-staining. Thus, it is preferred that the above cross-linking agent be used in a suitable amount taking into consideration photographic properties and so on.

The amount of the cross-linking agent used is preferably 0.05 to 50% by weight based on the weight of the solids of the emulsion.

In addition, an antistatic agent, a defoaming agent, a pH controlling agent, or an activating agent to prevent formation of coated domains, and the like can be added, if desired.

The weight ratio of the colloidal silica as the component (a) to the aqueous dispersion of the styreneacrylate copolymer as the component (b) is preferably 1/5 to 2/1.

Examples of the carboxyl group or sulfone group-containing water-soluble polymer compound or its salt to be used as the component (c) include sodium polyacrylate, and sodium polystyrenesulfonate. Hydrophilic organic polymer colloids include carboxyl-modified polyethylene and its salts.

The component (c) is used as an antistatic agent. The amount of the component (c) coated is preferably 0.005 to 1.0 g/m$^2$ and particularly preferably 0.01 to 0.5 g/m$^2$.

In accordance with the present invention, a coating solution containing at least the components (a) to (c) is prepared and coated on the back surface of the raw paper with polyolefin coated thereon. This coating solution may further contain a suitable amount of a surfactant in order to improve the levelling of the solution and thus to facilitate coating. In addition, for the purpose of increasing water resistance or alkali resistance of the back coat layer, a compound having at least two ethyleneimino groups or glycidyl ether groups in the molecule thereof is added as a cross-linking agent. Details of these cross-linking agents are described in JP-A-59-214849. Particularly preferred cross-linking agents are shown below.

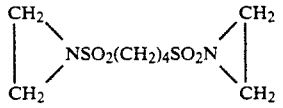
(1)

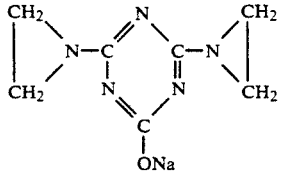
(2)

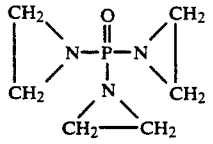
(3)

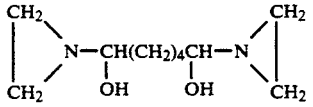
(4)

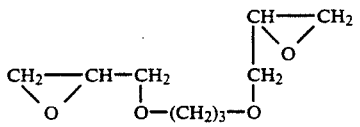
(5)

-continued

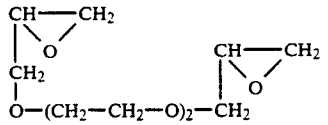
(6)

These cross-linking agents can be added to the component (b) and/or the coating solution containing at least the components (a) to (c) after preparation.

As a solvent for the preparation of the coating solution for the back coat layer, water or a mixture of water and alcohol is used.

As the alcohol, various alcohols such as methanol, ethanol, propyl alcohol, isopropyl alcohol, and butyl alcohol can be used.

In the present invention, the coating solution can be coated by generally well known techniques such as a dip coating method, an air knife coating method, a curtain coating method, a roller coating method, a doctor coating method, a wire bar coating method, a slide coating method, and a gravure coating method. Prior to coating, it is desirable that activation treatment be applied to the surface of the polyolefin layer by known methods.

For this activation treatment, etching treatment using an acid, flame treatment using a gas burner, corona discharging treatment, or glow discharging treatment, for example, can be employed.

The amount of the back layer coated is, as solid, preferably 0.05 to 1.0 g/m$^2$ and more preferably 0.1 to 0.5 g/m$^2$.

For production of a printing paper by coating the support of the present invention with a photographic emulsion, techniques commonly utilized for production of printing paper can be applied.

With regard to processing such as development and fixation of the printing paper thus obtained, commonly utilized techniques can be employed.

Printing paper produced using the support of the present invention is markedly decreased in contamination with oxidized products, such as organic compounds as eluted during the developing processing, and its ink writing properties are excellent.

The present invention is described in greater detail with reference to the following examples, although it is not intended to be limited thereto.

All parts are by weight.

EXAMPLES 1 TO 8, AND COMPARATIVE EXAMPLES 1 TO 7

A raw paper having a base weight of 150 g/m$^2$ and thickness of 160 μm was run at a speed of 10 m per minute, and its back surface was coated with high density polyethylene (density 0.960 g/cm$^3$, MI=13 g/10 minutes) in a resin thickness of 30 μm by melt extrusion by the use of a melt extruder to thereby form a matted resin layer.

Then, the top surface of the raw paper was coated with low density polyethylene (density 0.923 g/cm$^3$, MI=7 g/10 min.) containing 10% by weight of titanium dioxide in a resin thickness of 30 μm by melt extrusion by the use of a melt extruder to form a resin layer having a gloss surface.

To 50 parts of water was added 10 parts (as solid) of an aqueous dispersion of a styrene-acrylate copolymer (molar ratio of 70/30) obtained by polymerization in the presence of 3 parts of water-soluble polymer as shown in Table 1. Then, 10 parts of colloidal silica (trade name, Snowtex-C) having a particle diameter of 10 to 20 mμ and 5 parts of polyacrylic acid sodium salt were added, and further 25 parts of ethyl alcohol was added thereto to form an aqueous coating solution for the back layer, containing 10% by weight of styrene-acrylate copolymer.

After application of corona discharging treatment onto the polyethylene resin coated surface on the back side of the raw paper, the above coating solution was coated in an amount of 3.5 g/m$^2$ by a bar coating method, and then dried to produce a photographic support.

Then, after application of corona discharging processing onto the polyethylene resin coated surface at the top surface of the original, a blue-sensitive silver chlorobromide gelatin emulsion layer containing a yellow coupler, an intermediate layer, a green-sensitive silver chlorobromide gelatin emulsion layer containing a magenta coupler, an ultraviolet ray absorbing layer containing an ultraviolet ray absorbing agent, a red-sensitive silver chlorobromide gelatin emulsion layer containing a cyan coupler, and its protective layer were successively coated, and dried to produce a multi-layer silver halide color photographic printing paper.

TABLE 1

| | Styrene-Acrylate | Water-Soluble Polymer | Cross-Linking Agent* |
|---|---|---|---|
| Example 1 | Styrene-2-Ethylhexylacrylate | Styrene-Maleic acid | — |
| 2 | Styrene-2-Ethylhexylacrylate | PVA | — |
| 3 | Styrene-2-Ethylhexylacrylate | Carboxy-modified PVA | — |
| 4 | Styrene-Butyl acrylate | Styrene-Maleic acid | — |
| 5 | Styrene-Butyl acrylate | PVA | — |
| 6 | Styrene-Butyl acrylate | Carboxy-modified PVA | — |
| 7 | Styrene-2-Ethylhexyl acrylate | Styrene-Maleic acid | 0.5 |
| 8 | Styrene-Butyl acrylate | Styrene-Maleic acid | 0.5 |
| Comparative Example 1 | Butadiene-Styrene Rubber | — | — |
| 2 | Carboxy-modified Butadiene-Styrene Rubber | — | — |
| 3 | Nitrile Rubber | — | — |
| 4 | Styrene-2-Ethylhexylacrylate | — | — |
| 5 | Styrene-Butyl acrylate | — | — |
| 6 | Styrene-2-Ethylhexyl acrylate | — | 0.5 |
| 7 | Styrene-Butyl acrylate | — | 0.5 |

*Glycerol polyglycidyl ether was used as a cross-linking agent. The unit of addition amount is % by weight based on a coating solution.

Evaluation of Printing Paper

Each photographic printing paper as obtained above was stored for one day in a vessel maintained at 50° C. and relative humidity 60%, and then evaluated for ink printing properties, antistatic properties, and contamination of the back surface of the printing paper with contaminating substances.

Evaluation of Ink Printing Properties

The back coat layer was printed by the use of an impact printer placed in an automatic printer, and the state of disappearance of the print, when processed with a roll processor, was observed for evaluation. The rating was as follows: (A) the density of the print after the processing was nearly equal to that before the processing; and (B) the density of the print after the processing was much smaller than that before the processing.

Evaluation of Antistatic Properties

The back surface of the printing paper before color development was measured for surface inherent resistance when conditioned at 20° C. and 35% RH.

Contamination of Print Storing Layer with Contaminating Substances

By the use of a roll convey type of processor which was contaminated with black brown stains formed in the color developer with a lapse of time, the printing paper was developed through a color developing step (30° C., 3.5 min.), a bleach-fixing step (39° C., 1.5 min.), water rinsing step (30° C., 3 min.), and drying step (80° C., 20 sec.). Contamination formed by transfer of the black brown stains attached to the roll when the back surface of the printing paper was pressed by the roll in the color developer, to the back surface of the printing paper was examined with the naked eye.

The rating was as follows:

A: almost not stained;

B: stained slightly; and

C: badly stained.

The results are shown in Table 2.

TABLE 2

| | Charging Preventing Properties (Surface Inherent Resistance: Ω) | Ink Printing Properties | Attachment of Stains |
|---|---|---|---|
| Example 1 | $1.2 \times 10^9$ | A | A |
| 2 | $1.3 \times 10^9$ | A | A |
| 3 | $1.5 \times 10^9$ | A | A |
| 4 | $1.1 \times 10^9$ | A | A |
| 5 | $1.4 \times 10^9$ | A | A |
| 6 | $1.1 \times 10^9$ | A | A |
| 7 | $2.8 \times 10^9$ | A | A |
| 8 | $3.3 \times 10^9$ | A | A |
| Comparative Example 1 | $1.1 \times 10^9$ | B | B |
| 2 | $1.4 \times 10^9$ | B | B |
| 3 | $1.2 \times 10^9$ | B | B |
| 4 | $1.5 \times 10^9$ | B | B |
| 5 | $1.6 \times 10^9$ | B | B |
| 6 | $2.9 \times 10^9$ | A | C |
| 7 | $3.5 \times 10^9$ | A | C |

From the results of Table 2, it can be seen that the back surface of the photographic printing paper of the present invention (Examples 1 to 8) is good in ink printing properties, and further is free from contamination with staining substances and is sufficiently high in charging preventing ability.

While the invention has been described in detail and with reference to specific examples thereof, it will be apparatus to one skilled in the art that various changes and modifications can be made therein without departing from the spirit and scope thereof.

What is claimed is:

1. A support for photographic printing paper comprising a water resistant support comprising a raw paper with a polyolefin resin coated on both sides thereof, wherein the polyolefin resin comprises an α-olefin homopolymer, an α-olefin copolymer, or a mixture thereof, and has a molecular weight of 20,000 to 200,000, and a back layer provided on the support, wherein the back layer comprises:

(a) 0.01 to 1.0 g/m$^2$ of colloidal silica;

(b) a styrene-acrylate copolymer which is obtained from an aqueous dispersion obtained by polymerizing in the presence of a first water-soluble polymer selected from the group consisting of PVA, carboxyl-modified PVA, styrene-maleic acid copolymer and salts thereof, polyacrylic acid, polystyrenesulfonic acid, and a water-soluble acryl compound, wherein the molar ratio of styrene to acrylate is in a range of about 90/10 to about 10/90 and the acrylate monomer portion of the styrene-acrylate copolymer is selected from the group consisting of esters of acrylic acid and aliphatic alcohols having 1 to 8 carbon atoms, and the weight ratio of the colloidal silica to the aqueous dispersion of the styrene-acrylate copolymer is 1/5 to 2/1; and (c) at least one member selected from the group consisting of a second water-soluble polymer for imparting anti-static property to the back layer containing a carboxylic group or a sulfone group or its salt, and a hydrophilic organic polymer colloid.

2. The support as claimed in claim 1, wherein said back layer contains a compound having at least two ethyleneimino groups or glycidylether groups in the molecule thereof as a cross-linking agent.

3. The support as claimed in claim 1, wherein said colloidal silica is used in an amount from 0.05 to 0.5 g/m$^2$.

4. The support as claimed in claim 1, wherein the amount of component (c) coated is 0.01 to 0.5 g/m$^2$.

5. The support as claimed in claim 1, wherein said back layer, as a solid, is coated in an amount from 0.1 to 0.5 g/m$^2$.

6. The support as claimed in claim 2, wherein said compound is used in an amount from 0.05 to 50% by weight.

7. The support as claimed in claim 1, wherein the colloidal silica has an average particle diameter of about 5 to 100 μm.

8. The support as claimed in claim 7, wherein the average particle diameter is 10 to 50 μm.

9. The support as claimed in claim 1, wherein the colloidal silica is a silica sol suspension.

10. The support as claimed in claim 1, wherein the polyolefin resin is selected from the group consisting of high density polyethylene, low density polyethylene and mixtures thereof.

11. The support as claimed in claim 1, wherein the molar ratio of styrene to acrylate is 50/50 to 80/20.

12. The support as claimed in claim 1, wherein the molecular weight range of the styrene-acrylate copolymer is in the range of 100,000 to 1,000,000.

13. The support as claimed in claim 12, the molecular weight range is 200,000 to 500,000.

14. The support as claimed in claim 1, wherein the acrylate monomer is selected from the group consisting of methyl acrylate, ethyl acrylate, n-propyl acrylate, isopropyl acrylate, n-butyl acrylate, sec-butyl acrylate, tert-butyl acrylate, hydroxypropyl acrylate, 2-hydroxyethyl acrylate, and 2-ethylhexyl acrylate.

15. The support as claimed in claim 1, wherein the styrene-acrylate copolymer is copolymerized with a cross-linkable divinyl compound, an N-containing monomer, a carboxyl group-containing component, a glycidyl group-containing component or a hydroxyl group-containing monomer.

16. The support as claimed in claim 1, wherein the second water-soluble polymer compound is selected from the group consisting of sodium polyacrylate and sodium polystyrenesulfonate.

17. The support as claimed in claim 1, wherein the hydrophilic organic polymer colloid is selected from the group consisting of carboxyl-modified polyethylene and salts thereof.

* * * * *